US009874070B2

(12) United States Patent
Hanson et al.

(10) Patent No.: US 9,874,070 B2
(45) Date of Patent: Jan. 23, 2018

(54) TENSION-SET TIEBACK PACKER

(71) Applicant: Weatherford Technology Holdings, LLC, Houston, TX (US)

(72) Inventors: Andrew J. Hanson, Edmonton (CA); Brian E. Hilhorst, Beaumont (CA); James A. C. MacTavish, Edmonton (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 196 days.

(21) Appl. No.: 14/693,076

(22) Filed: Apr. 22, 2015

(65) Prior Publication Data

US 2016/0312569 A1 Oct. 27, 2016

(51) Int. Cl.

| | |
|---|---|
| ***E21B 33/128*** | (2006.01) |
| ***E21B 33/129*** | (2006.01) |
| ***E21B 23/06*** | (2006.01) |

(52) U.S. Cl.

CPC ..... *E21B 33/1292* (2013.01); *E21B 23/06* (2013.01); *E21B 33/128* (2013.01)

(58) Field of Classification Search

CPC .. E21B 33/134; E21B 33/128; E21B 33/1292; E21B 23/06

See application file for complete search history.

(56) References Cited

U.S. PATENT DOCUMENTS

| | | | | |
|---|---|---|---|---|
| 1,859,744 | A | 5/1932 | Meyer | |
| 3,861,465 | A * | 1/1975 | Mignotte | E21B 33/12 166/127 |
| 5,884,699 | A * | 3/1999 | Mullen | E21B 33/1293 166/134 |
| 7,114,573 | B2 | 10/2006 | Hirth et al. | |
| 8,561,709 | B2 | 10/2013 | Arce et al. | |
| 2004/0216877 | A1 | 11/2004 | Pedersen et al. | |
| 2014/0238689 | A1 * | 8/2014 | Hughes | E21B 33/128 166/377 |

OTHER PUBLICATIONS

D&L Oil Tools, "DL Tension & DL Shear Tension Packer," Product Brochure, revision dated Oct. 2014.

(Continued)

*Primary Examiner* — Zakiya W Bates
(74) *Attorney, Agent, or Firm* — Blank Rome, LLP

(57) ABSTRACT

An apparatus for supporting tubing in casing includes a setting tool and a liner top packer, which can be used for tieback. A setting slip is disposed uphole of a packing assembly on the packer and is movable from a retracted to an extended state engaging the casing. The setting tool has a temporary connection to the packer and has a pack-off that seals the tool in the packer but allows for movement. After running downhole, the temporary connection of the setting tool to the packer is disconnected, and the setting slip is set in the casing by moving the setting tool in an uphole direction. To set the packing assembly, the packer is moved in the uphole direction by engaging the setting tool with the pack-off and compressing the packing element (e.g., packing element and opposing cones and slips) against the set setting slip. Eventually, the setting tool is disconnected from the packer by disengaging the pack-off.

40 Claims, 16 Drawing Sheets

(56) References Cited

OTHER PUBLICATIONS

D&L Oil Tools, "DL Tension Packer," Product Brochure, revision dated Oct. 2014.
Team Oil Tools, "Completion Tools Catalog," Product Catalog, copyright 2012.
Baker Hughes, "Reliant(TM) 10 Hornet(TM) Mechanical Tension Set Packer," Technical Guide, dated May 31, 2012.
TIW Corporation, "L Liner Top Packer," Product Brochure, undated, obtained from http://www.tiwtools.com/linerhangarsystems/Liner-Packers on Mar. 25, 2015.
TIW Corporation, "LX Liner Top Packer," Product Brochure, undated, obtained from http://www.tiwtools.com/linerhangarsystems/Liner-Packers on Mar. 25, 2015.
TIW Corporation, "HLX Liner Top Packer," Product Brochure, undated, obtained from http://www.tiwtools.com/linerhangarsystems/Liner-Packers on Mar. 25, 2015.
Team Oil Tools, "32A Tension Set Packer," Product Brochure, copyright 2012.
Weatherford, "ArrowSet I-X Mechanical Production Packers," Product Brochure, copyright 2003.
Weatherford, "APC-1 Tandem Tension Packer," Product Brochure, copyright 2007.
First Office Action in counterpart Canadian Appl. 2,927,497, dated Dec. 13, 2016, 3-pgs.

* cited by examiner

TENSION-SET TIEBACK PACKER

BACKGROUND OF THE DISCLOSURE

A liner top packer is run as a part of a liner-hanger assembly to create a reliable liner-top seal between the host casing and the liner string. Additionally, the liner top packer can isolate formation pressures below the liner top from the casing above, can isolate treating pressures or acid work below the liner top from the casing, can isolate fluids while cement sets, can mitigate gas migration, and can isolate lost circulation zones. The liner top packer can also be used as a tieback completion or production packer. Therefore, the liner top packer serves a number of important and useful purposes.

In current techniques, hydraulics are used to set a liner top packer. For example, a liner top packer 30 as shown in FIG. 1A is hydraulically set in casing 10 with a hydraulic setting tool 20. The setting tool 20 has a bushing 22 disposed on a splined shaft 24 and threaded to a lock sub 31 of the packer 30. The setting tool 20 also includes hydraulic pistons 26 and a setting sleeve 28. The packer 30 includes a mandrel 32 coupled to the lock sub 31. Opposing slips 34 and cones 36 are disposed on the mandrel 32 on either side of a packing element 38.

During setting operations, the setting tool 20 is coupled by the bushing 22 to the lock sub 31 and packer's mandrel 32 to run the packer 30 in the casing 10. When setting depth is reached, hydraulic pressure communicated in the setting tool 20 actuates the pistons 26, which pushes the setting sleeve 28 downward to compress the slips 34, the cones 36, and the packing element 38 and to set the packer 30. To build up pressure, a sub 23 threaded into splined shaft 24 accepts a ball, which seals off the tubing to build pressure in the pistons 26. Rotation of the setting tool 20 then unthreads the bushing 22 from the lock sub 31 so the tool 20 can be retrieved.

As an alternative to the use of hydraulics, current techniques run and mechanically set a separate liner hanger below a liner top packer so a compression setting tool can then be used to set the liner top packer. For example, a liner top packer 30 as shown in FIG. 1B is coupled uphole of a separate liner hanger 35. The packer 30 has a packing element 38 disposed on the mandrel 32. The liner hanger 35 has slips 37*a* that are moved against cones 37*b* using a J-slot mechanism 39.

The packer 30 and liner hanger 35 are run in hole with the setting tool 20. When setting depth is reached, the liner hanger 35 is set in the casing 10 by operating the J-slot mechanism 39 and wedging the slips 37*a* with the cones 37*b* against the casing 10. At this point, rotation of the setting tool 20 unthreads the bushing 22 from the lock sub 31. The setting tool 20 is then lifted uphole inside the surrounding setting sleeve 28 until dogs 25 on the tool 20 bias outward beyond the distal end of the sleeve 28. Downhole movement of the setting tool 20 then engages the dogs 25 against the sleeve 28 so the sleeve 28 can be pushed against the packing element 38 on the packer 30 to set it against the casing 10. The setting tool 20 can then be removed.

Although these current techniques are successful, they may not be suitable for some implementations. For instance, using hydraulics downhole may be undesirable in implementations that have multi-zone open hole equipment that is pressure activated. Also, using a separate liner hanger adds additional cost to the assembly, which may be undesirable. These and other reasons may make alternative techniques more favorable for setting a liner top packer.

The subject matter of the present disclosure is directed to overcoming, or at least reducing the effects of, one or more of the problems set forth above.

SUMMARY OF THE DISCLOSURE

According to the present disclosure, an apparatus for supporting tubing, such as a liner, in casing of a borehole includes a packer and a setting tool. A housing of the packer defines a bore and is coupled to the tubing extending downhole therefrom. A packing assembly of the packer is disposed on the housing and includes a packing element, hanging slips, and hold-down slips. The packing element is compressible from an unpacked state to a packed state in the casing. The hanging slip disposed toward the downhole end of the packing element keeps the housing from moving downhole. The hold-down slip disposed toward the uphole end of the packing element keeps the housing from moving back uphole due to pressure from below.

Separate from the packing assembly and its hanging, packing, and hold-down functions, a setting slip of the packer is disposed on the housing uphole of the packing assembly and is movable from a retracted state away from the casing to an extended state toward the casing. As will be described below, the setting slip is used for actuation and not necessarily any hanging or hold-down function.

The setting tool has a first temporary connection to the housing. A first portion of the setting tool temporarily maintains the setting slip in the retracted state. This first portion mechanically moves in an uphole direction relative to the housing after disconnection of the first temporary connection and permits the setting slip to move to the extended state in the casing.

A second portion of the setting tool mechanically moves the housing in the uphole direction after extension of the setting slip. This second portion moves the packing assembly against the engaged setting slip and compresses the packing assembly to the engaged state in the casing. In particular, the hanging slip, packing element, and hold-down slip are compressed against the engaged setting slip, which wedges the hanging and hold-down slips against the casing and compresses the packing element against the casing.

In one embodiment, the setting tool is rotatable relative to the housing to remove the first temporary connection to the housing. For example, the first temporary connection can include a nut disposed on a splined shaft of the setting tool and threaded to a first internal thread in the bore of the housing.

The first portion of the setting tool includes a sleeve disposed external to the housing. The sleeve in a first axial position relative to the housing holds the setting slip in the retracted state, and the sleeve in a second axial position relative to the housing releases the hold of the setting slip. The setting slip can include a biasing element biasing the setting slip from the retracted state toward the extended state.

As an alternative, the sleeve disposed external to the housing in a first axial position relative to the housing holds a first setting cone away from the setting slip. Yet, the sleeve in a second axial position relative to the housing wedges the first setting cone against the setting slip.

In this alternative arrangement, the setting slip has a first shearable connection temporarily holding the setting slip in the retracted state, which can shear in response to the first setting cone wedging against the setting slip. The sleeve has a second shearable connection temporarily holding the sleeve to a second setting cone disposed adjacent the setting slip opposite to the first setting cone. The second shearable connection is shearable in response to the sleeve moving from the first axial position toward the second axial position. Finally, the sleeve has a third shearable connection temporarily holding the sleeve to the first setting cone. This third shearable connection is shearable in response to the sleeve moving in the downhole direction. Although the third connection can also shear in the uphole, the third connection is configured to shear at a higher force than the first and second connections.

The second portion of the setting tool includes a second temporary connection to the housing. The second temporary connection can include a pack-off sealing the setting tool inside the bore of the housing. For example, the pack-off can have one or more seals sealing against an exterior portion of the setting tool and against the bore of the housing.

The second portion of the setting tool is movable in the uphole direction against the second temporary connection. Thus, the second portion is moved against the second temporary connection moving the housing in the uphole direction.

The second portion can have a shoulder disposed thereon and configured to engage the second temporary connection. The shoulder can be biased on the second portion by a biasing element against the engagement with the second temporary connection. The shoulder can also define one or more first castellations configured to mate with one or more second castellations of the second temporary connection.

In one embodiment, the second temporary connection includes a nut rotatably disposed on the setting tool and threaded to second internal thread in the bore of the housing. The nut unthreads from the second internal thread with rotation of the second portion of the setting tool engaged with the nut. Alternatively, the second temporary connection can include a dog disposed on the setting tool and engaged in the bore of the housing. The dog disengages from the bore with the movement of the second portion in the uphole direction.

According to the present disclosure, a method of supporting tubing in casing of a borehole involves running the tubing in the casing with a setting tool coupled to a packer on the tubing. A first portion of the setting tool is disconnected from the packer, and a setting slip on the packer is set in the casing by moving the first portion of the setting tool in an uphole direction relative to the packer. The packer is moved in the uphole direction by engaging a second portion of the setting tool with the packer, and the packing assembly on the packer sets in the casing by compressing the packing assembly against the set setting slip. Finally, the second portion of the setting tool is disconnected from the packer.

In a first embodiment, the tool has spring-loaded, retained setting slips. A running tool retains the slips until the liner is at depth. The running tool is then released from the liner, allowing the slips to expand. Cementing may then be performed. The running string is then used to tension set the packer as the setting tool coupling pulls on the shearable pack-off component. After the packer is set and sufficient pack-off is applied, additional force is applied to shear out the pack-off component and retrieve the string. The tool uses spring loaded, setting slips retained by the running profile until depth is reached. Once depth is reached, the setting slips are released to anchor the packer for setting in tension.

In the disclosed embodiments, setting the packer does not require hydraulics, and the assembly does not require a separate liner hanger. Using the frictional factors between the tools and the casing allows setting a compression set packer with upstroke.

The packer as disclosed herein can be a liner top packer run as a part of a liner hanger assembly. The liner packer can create a liner-top seal between host casing and a liner string, can isolate formation pressures below the liner top from the casing above, can isolate treating pressures or acid work below the liner top from the casing, can isolate fluids while cement sets, can mitigate gas migration, can isolate lost circulation zones, etc. The disclosed packer can also be used as a tieback completion or production packer.

The foregoing summary is not intended to summarize each potential embodiment or every aspect of the present disclosure.

BRIEF DESCRIPTION OF THE DRAWINGS

FIG. 2A illustrates an assembly according to the present disclosure having a liner top packer and a setting tool during run in.

DETAILED DESCRIPTION OF THE DISCLOSURE

FIGS. 2A through 2G show an assembly 50 according to the present disclosure having a packer 200 and a setting tool 100. The assembly 50 is shown in a number of positions from running in hole to pulling out of hole. As noted, the packer 200 as disclosed herein can be a liner top packer run as a part of a liner hanger assembly. Additionally, the disclosed packer can also be used as a tieback packer by allowing the liner to be extended to the surface or farther uphole in a tieback arrangement.

Figure 1A:
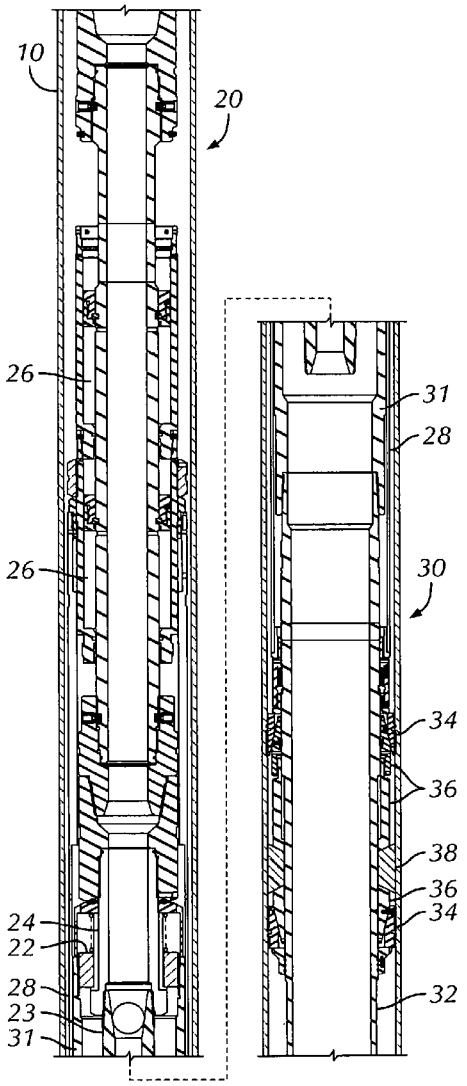
FIG. 1A (Prior Art)
FIG. 1A illustrates a prior art technique for setting a liner top packer using a hydraulic setting tool.
Figure 1B:
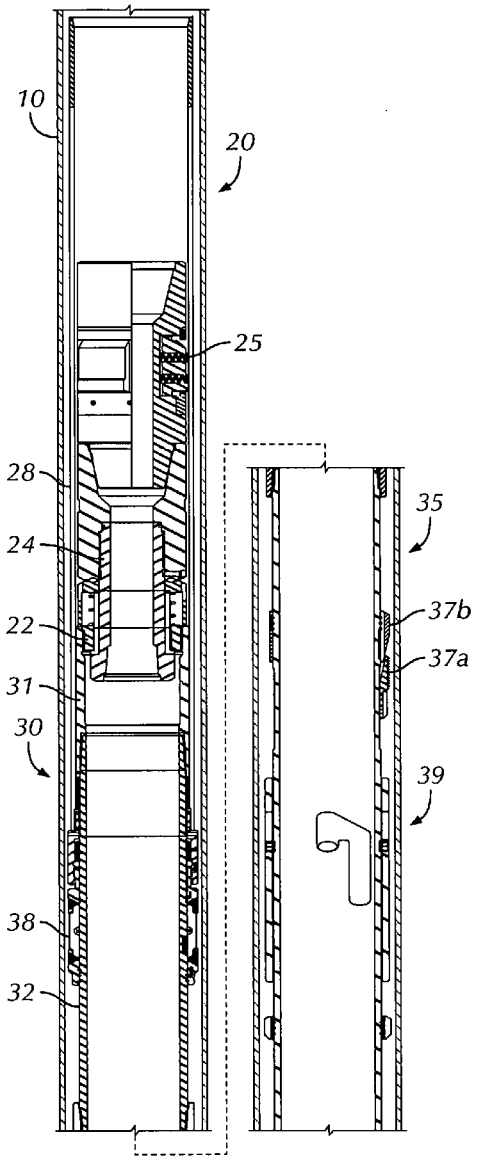
FIG. 1B (Prior Art)
FIG. 1B illustrates another prior art technique for setting a liner top packer using a separate liner hanger and setting tool.
Figure 2A:
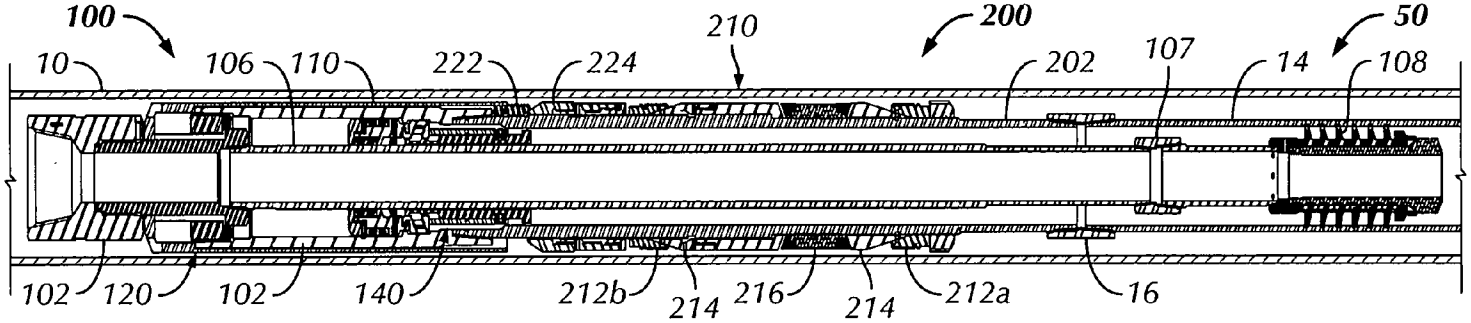

Looking first at FIG. 2A, the liner top packer 200 and the setting tool 100 are shown during run-in. The liner top packer 200 includes a housing having a mandrel 202 coupled at a downhole end to liner tubing 14 by a coupling 16. A latch sub 204 of the housing is coupled at an uphole end of the mandrel 202 and has a pack-off component 140 installed therein.

The setting tool 100 extends through the mandrel 202 and latch sub 204 and has an upper coupling 102 for attaching to a running string (not shown). The upper end of the setting tool 100 has a retention sleeve 110 and a bushing assembly 120. A pup or pipe section 106 extends from the coupling 102 through the pack-off component 140 and connects by a coupling 107 to a removable wiper 108.

The liner top packer 200 has a conventional packing assembly 210 with opposing slips 212*a-b* that can ride up cones 214 on both sides of a packing element 216, such as a compressible elastomeric sleeve. In particular, the packing element 216 is compressible from an unpacked state to a packed state in the casing 10. The hanging slips 212*a* when set toward the downhole end of the packing element 216 keep the housing 202 from moving downhole. The hold-down slips 212*b* when set toward the uphole end of the packing element 216 keep the housing 202 from moving back uphole due to pressure from below. Uphole of these conventional packing components, the packer 200 has a ratcheting cone 224 and setting slips 222.

During run-in as shown in FIG. 2A, the retention sleeve 110 holds the setting slips 222 retracted from the casing 10, and the packing assembly 210 (e.g., 212*a-b*, 214, 216) on the packer 200 are uncompressed away from the casing 10 in which the packer 200 is run. The bushing 120 on the setting tool 100 engages the latch sub 204 so that the setting tool 100 can run the packer 200 through the casing 10. Meanwhile, the pack-off component 140 encloses the setting tool's pipe section 106 inside the packer 200.

Figure 3:
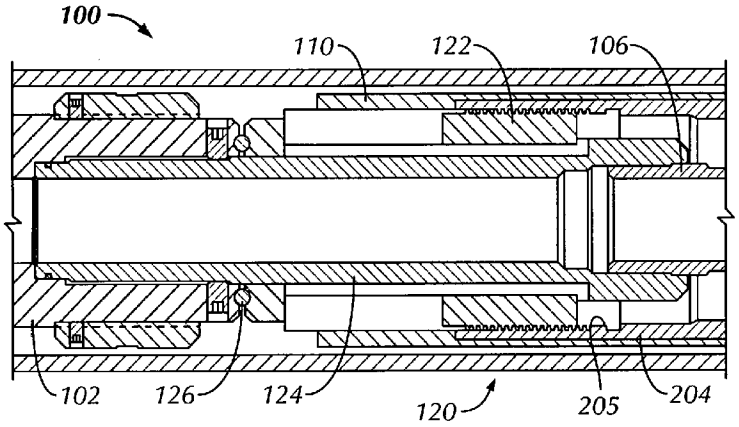
FIG. 3 illustrates a detail of the setting tool and upper end of the setting sleeve.

Some details of the running tool 100 are shown in FIG. 3. Hydraulic setting mechanisms are not present on the setting tool 100 because the liner top packer 200 is set with tension, as will be described below. Instead, the running tool 120 has a nut or bushing 122 disposed on a splined shaft 124. The splined shaft 124 couples at an uphole end to the tool's coupling 102 and couples at its downhole end to the pipe section 106. Rotation of the coupling 102 thereby rotates the splined shaft 124 and the pipe section 106. Rotation of the splined shaft 124 rotates the nut 122 thereon relative to internal thread 205 in the latch sub 204.

The outer sleeve 110 extends from the coupling 102 over the packer's latch sub 204. However, rotation of the coupling 102 is disengaged from the sleeve 110 by bearings 126. In this way, rotating the running tool 100 to turn the nut 122 in the internal threads 205 of the latch sub 204 does not rotate the sleeve 110.

Figure 4:
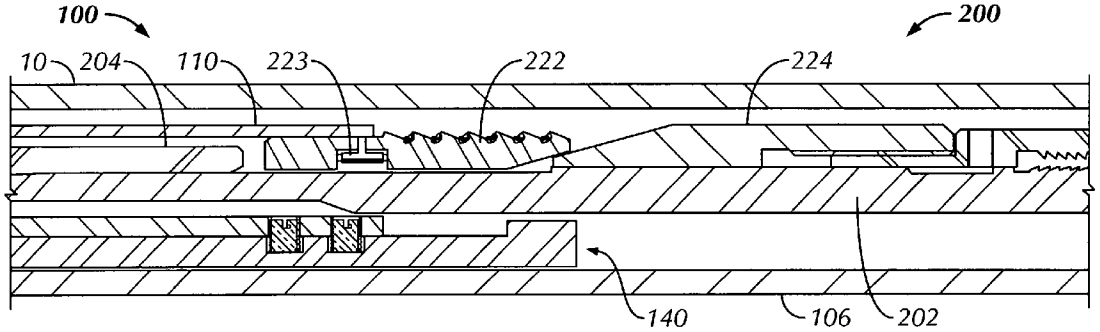
FIG. 4 illustrates a detail of on arrangement of the setting sleeve retaining the setting slips against the mandrel of the packer.

Some further details of the running tool 100 and packer 200 are shown in FIG. 4. As shown, the end of the setting sleeve 110 extends over portion of the packer 200 and portion of the setting slips 222. In this condition, the setting slips 222 can be held in a retracted state away from the casing 10. Biasing elements, such as springs 223, can force the setting slips 222 outward away from the mandrel 202.

Figure 2B:
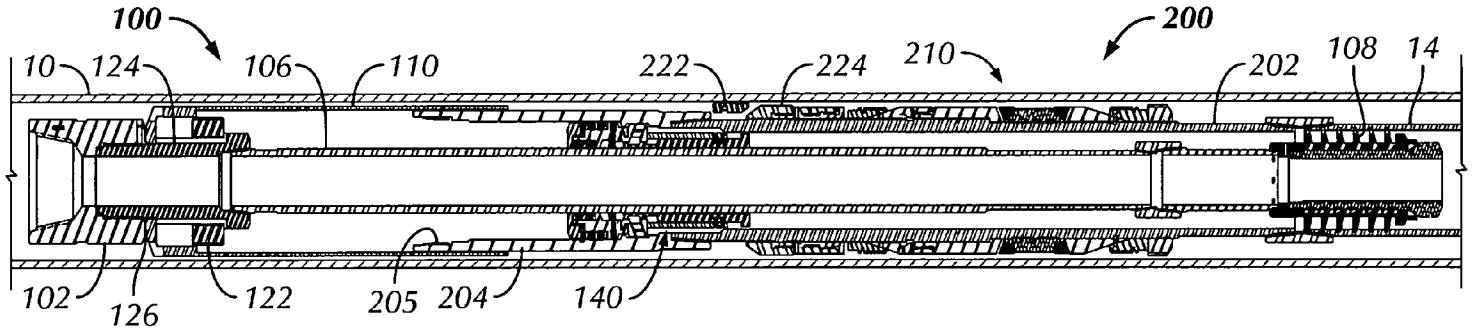
FIG. 2B illustrates the disclosed assembly during partial release of the setting tool.
Figure 2C:
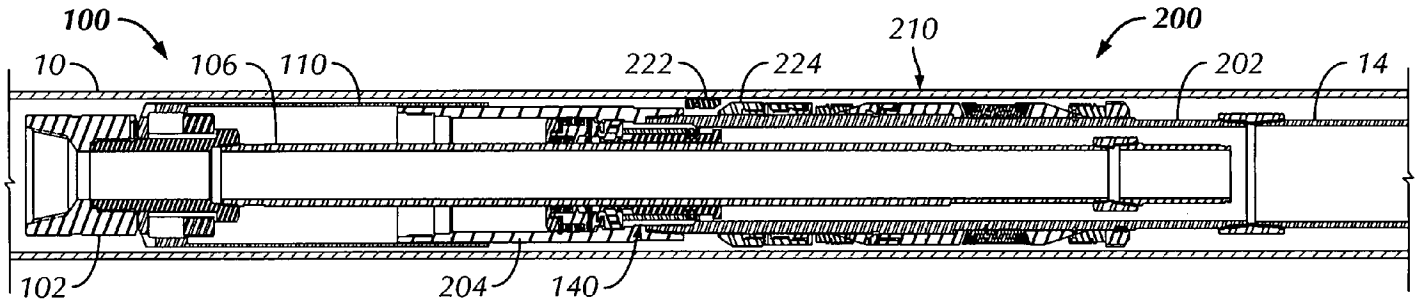
FIG. 2C illustrates the disclosed assembly during cementing.
Figure 2D:
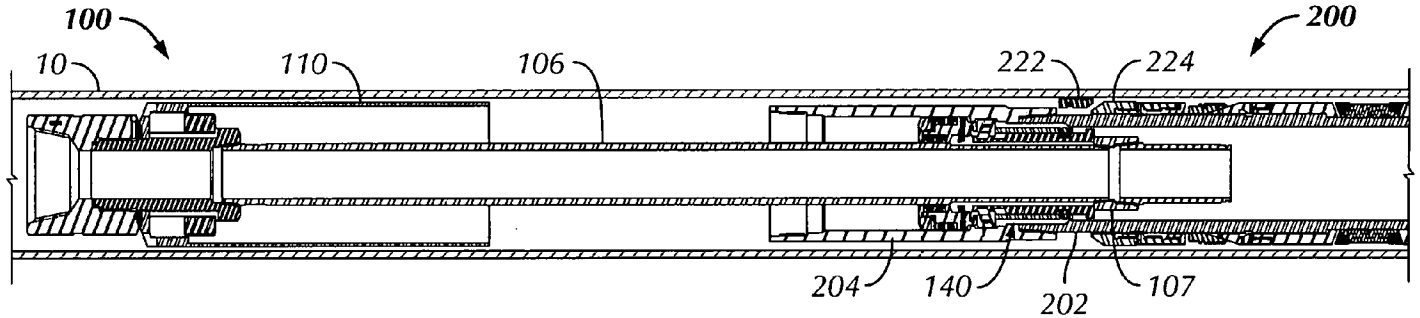
FIG. 2D illustrates the disclosed assembly during initial setting stages.
Figure 2E:
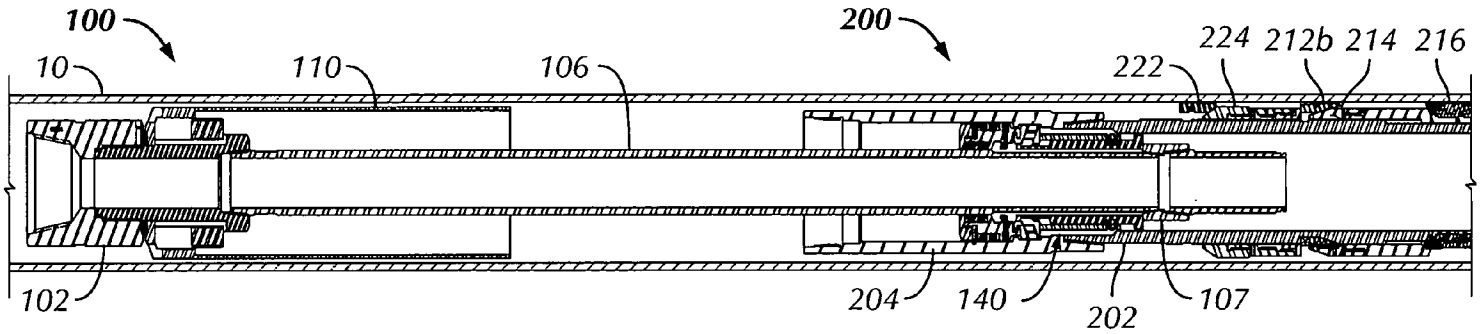
FIG. 2E illustrates the disclosed assembly during a set condition.

Looking now at FIG. 2B, the setting tool 100 is released when setting depth is reached. At this point, cementing operations can be performed. The cement (not shown) follows a cementing plug (not shown) and can pass down through the running string (not shown) and setting tool's pipe section 106. The cementing plug (not shown) engages the wiper 108, pushing it off the end of the pipe section 106 as shown in FIG. 2C, for example, as the cement behind it continues down the liner tubing 14.

To run and release as in FIG. 2B, the setting tool 100 and packer 200 are run to depth, cycling through tension and compression as required. Once the desired depth is reached, the running nut 122 is unthreaded from the internal thread 205 of the latch sub 204 via right hand rotation to the running string and tool 100. This rotation is typically in compression to make use of the bearing balls 126. Any suitable number of turns (e.g., approximately 11 turns) can be required. The nut 122 has a left-hand thread and is splined to the shaft 124 of the running tool 100 so that right hand rotation unthreads it from the latch sub 204.

Figure 5:
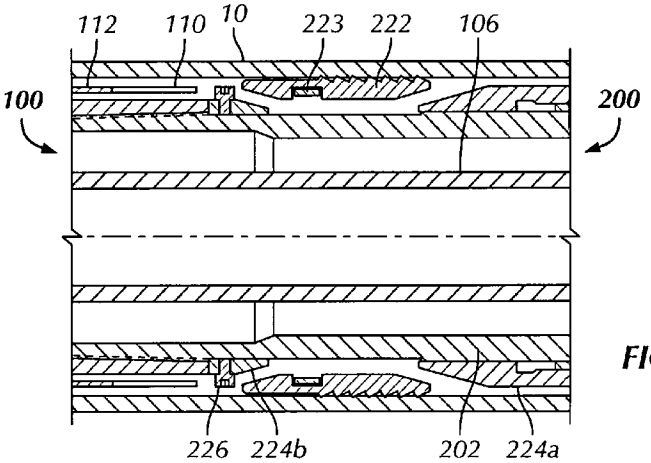
FIG. 5 illustrates a detail of another arrangement of the setting sleeve disengaged from the setting slips.

Once the nut 122 is unthreaded from the latch sub 204, the running string and tool 100 are now moved uphole. Within the first few inches of uphole travel, the setting sleeve 110 slides uphole of the retained setting slips 222, allowing the slips 222 to move from an unset state toward a set state against the casing 10. For example, the springs 223 force the setting slips 222 to engage outwards into the casing 10. An example of this condition is shown in FIG. 5. The setting slips 222 do not encompass the full circumference of the packer 200. This allow for annular area around the slips 222 when cementing. However, the middle slips 212 on the packer 200 may be full circle and perform a hold down function.

When cementing is completed, operators being setting the liner top packer 200. Looking now at FIG. 2D, the setting tool 100 is pulled uphole so that a shoulder, such as provided on the coupling 107, engages the pack-off component 140. As then shown in FIG. 2E, further pulling uphole of the setting tool 100 moves the pack-off component 140, the latch sub 204, and the packer 200 with it. The ratcheting cone 224 on the packer 200 wedges against the expanded setting slips 222. The pulling force further engages the slips 222 against the casing 10, and the ratchet cone 224 ratchets along the mandrel 202 and forces against the slips 212*a-b*, cones 214, and packing element 216 of the packer 200. To prevent reverse movement of the cone 224, a body lock ring and other comparable component can be used.

Figure 2F:
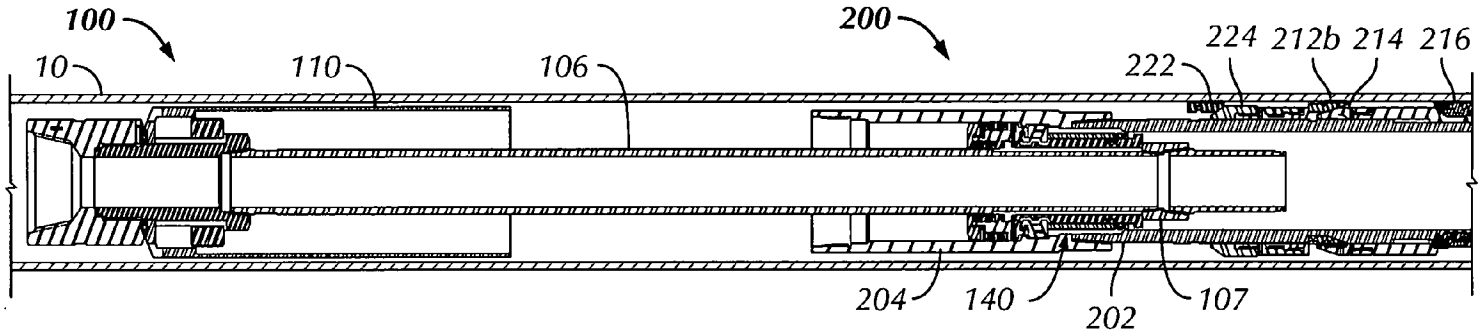
FIG. 2F illustrates the disclosed assembly during release of the setting tool.
Figure 2G:
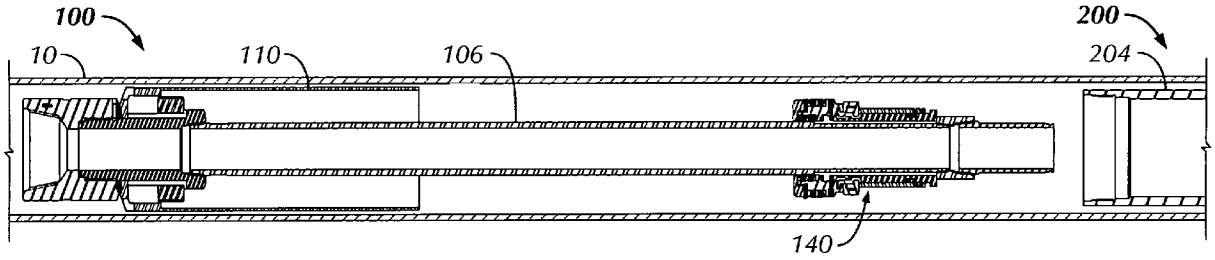
FIG. 2G illustrates the disclosed assembly during pulling out of the setting tool.

The required tensile load can be applied and held for a suitable period of time to allow proper elastomer setting of the packer element 216. Typically, a tensile load of about 50,000-lbf over liner drag is applied for this type of packer for about 10 minutes. Eventually, as shown in FIG. 2F, the setting tool 100 removes the pack-off component 140 from the latch sub 204, and the setting tool 100 and disengaged pack-off component 140 can then be pulled out of hole, as shown in FIG. 2G.

In one embodiment of the setting tool 100 and packer 200 illustrated in FIG. 5, a secondary cone 224*b* can be disposed at the uphole end of the mandrel 202 on the opposite side of the setting slips 222 from the retention cone 224*a*. Cap screws 226 on the secondary cone 224*b* can initially be fit in end slots 112 of the sleeve 110 when moved over the setting slips 222 while retracted against the mandrel 202. In the event setting procedures are hindered when the sleeve 110 is retracted, the secondary cone 224*b* can be activated using the cap screws 226 and sleeve 110. For instance, the retracted sleeve 110 can be rotated to misalign the slots 112 from the cap screws 226. Pushing of the sleeve 110 downward can engage the edge of the sleeve 110 against the cap screws 226 and can then push the upper cone 226*b* against the slips 222.

Figure 6:
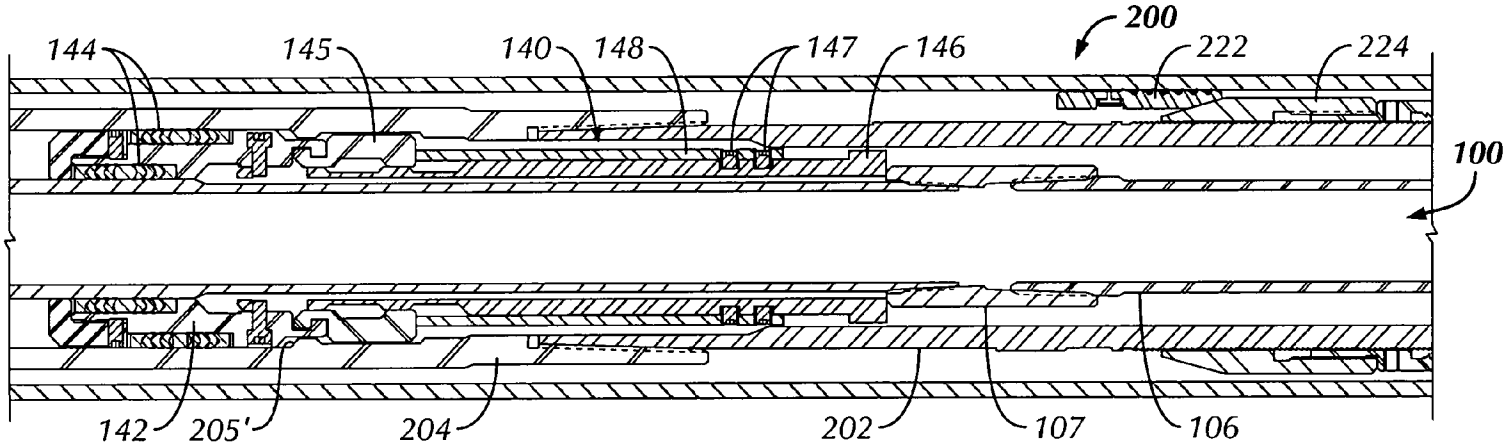
FIG. 6 illustrates a detail of the setting tool's coupling engaging the bushing assembly.

In one embodiment of the setting tool 100 and packer 200 illustrated in FIG. 6, the pack-off component 140 can be retained by dogs 145 held on a pack-off body 142. Seals 144 (e.g., chevron seals) on the pack-off body 142 seal inside the latch sub 204 and against the pipe section 106 of the setting tool 100. The dogs 145 connect to the body 142 and are held in a profile 205' of the latch sub 204 using a pair of sleeves, including a drive sleeve 146 and a stop sleeve 148 affixed together with shear pins 147.

As noted above, setting the packer 200 involves engaging the shoulder (e.g., provided by the coupling 107) against the drive sleeve 146. The packer 200 sets before the shear values of the shear pins 147 are reached. Eventually, the pack-off component 140 is disengaged from the latch sub 204 when sheared free of the stop sleeve 148. When this happens, the drive sleeve 146 pushes toward the body 142, freeing the dogs 145 from the profile 205'. The pack-off component 140 at this point can then move with the pipe section 106 when the setting tool 100 is removed from the packer 200.

Figure 7A:
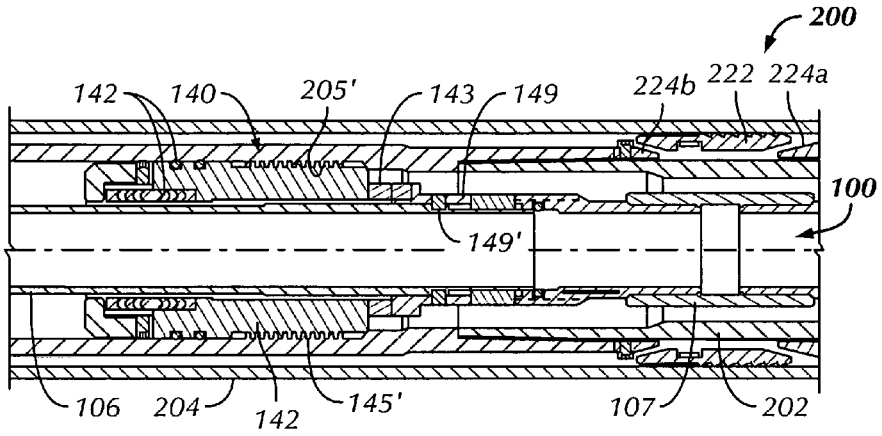
FIG. 7A illustrates a detail of the bushing engaged in the latch sub having its castellations misaligned with those on a shear sub.
Figure 7B:
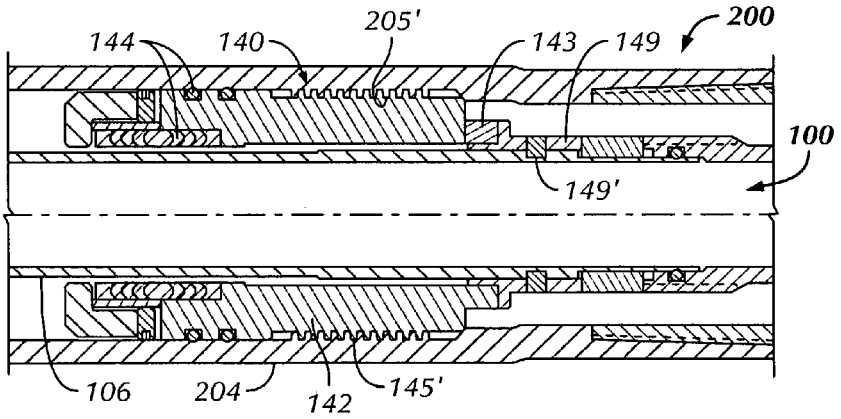
FIG. 7B illustrates a detail of the bushing engaged in the latch sub having its castellations aligned with those on the shear sub.

In another embodiment of the setting tool 100 and packer 200 illustrated in FIGS. 7A-7B, the pack-off component 140 can be threaded in the latch sub 204. Again, seals 144 (e.g., chevron seal and O-ring) on the pack-off body 142 seal inside the latch sub 204 and against the pipe section 106 of the setting tool 100. The body 142 is a nut or threaded bushing having external threads 145' threaded into internal thread 205' in the latch sub 204.

Disengaging the pack-off component 140 from the latch sub 204 involves engaging a shear sub 149 disposed on the pipe section 106 against the bushing 142. Engagement between the bushing 142 and shear sub 149 then allows rotation of the pipe section 106 to transfer to rotation of the nut 142.

As can be seen in FIGS. 7A-7B, for example, castellations 143 are disposed between the threaded bushing 142 and the shear sub 149. These castellations 143 are shown misaligned in FIG. 7A. Once a spike on a weight indicator is seen at surface during engagement of the sub 149 with the bushing 142, slight right-hand rotation is applied, less than ½ turn, to align the castellations 143 between the threaded bushing 142 and shear sub 149. The castellations 143 are subsequently shown in FIG. 7B in an aligned condition.

With the engagement made, the tensile load to set the packer 200 can be applied as required. When setting is complete, the load is then decreased to neutral and a number (approximately 10) turns to the right are applied to unthread the threaded bushing 142 from the latch sub 204. The rotation of the tool's pipe section 106 eventually unthreads the bushing 142 from the thread 205' of the latch sub 204, at which point the pack-off component 140 can move with the pipe section 106 as the setting tool 100 is removed from the packer 200. The shear sub 149 and threaded bushing 142 are both re-usable components as is the running tool 100.

In the event that the threaded bushing 142 does not rotate out of the latch sub 204, operators may apply an over-pull tension (e.g., 100,000 lbf or whatever shear value is desired) to shear out emergency release shear screws 149' shown in FIGS. 7A-7B. In this event, the running string may be retrieved, but the threaded bushing 142, the shear sub 149, and other components would then have to be fished. Even though this is not an ideal condition, it is far better than having the running string with running tool 100 stuck down hole.

FIGS. 8A through 8K show another assembly 50 according to the present disclosure having a liner top packer 200 and a setting tool 100. This assembly 50 is similar to that disclosed above so that like reference numerals are used for similar components between the embodiments. Certain descriptions of similar components may not be repeated here.

Figure 8A:
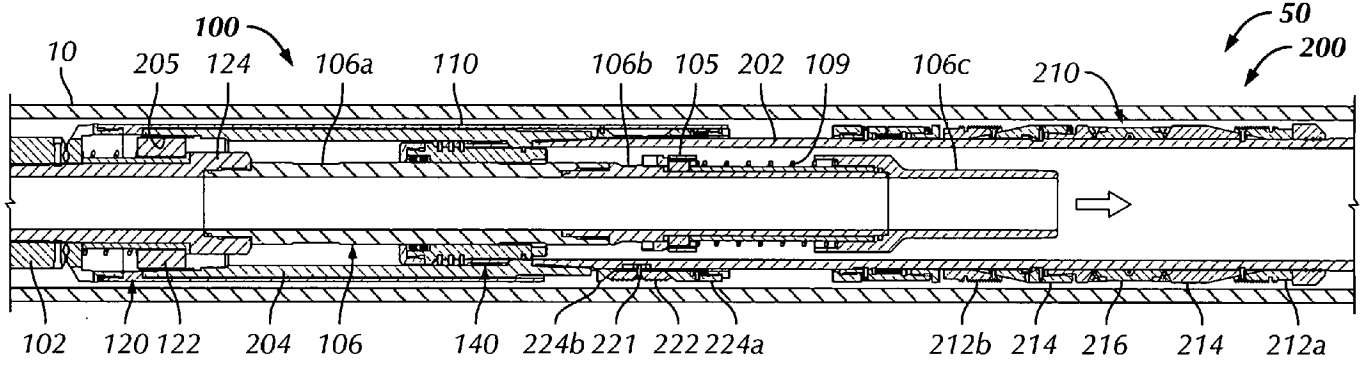
FIGS. 8A-8K illustrate another assembly according to the present disclosure having a liner top packer and a setting tool during setting procedures.

Looking first at FIG. 8A, the liner top packer 200 and the setting tool 100 are shown during run-in. As before, the liner top packer 200 includes the mandrel 202 coupled at a downhole end to tubing (not shown) and coupled at an uphole end to the latch sub 204, which has the pack-off component 140 installed therein. Additionally, the liner top packer 200 has the conventional packing assembly 210 with the opposing slips 212*a-b* that can ride up cones 214 on both sides of the packing element 216.

Figure 9A:
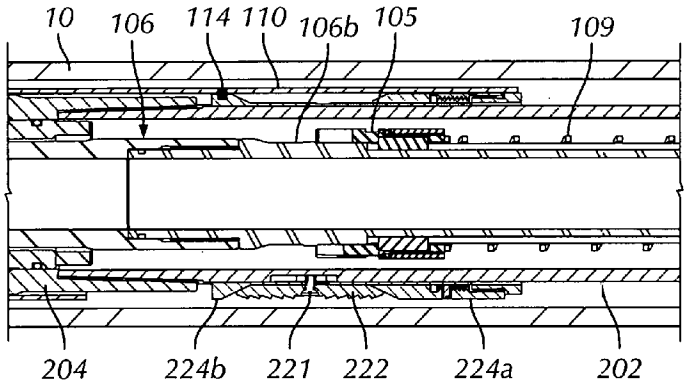
FIG. 9A illustrates a detail of the setting slips and related elements on the disclosed packer.

Uphole of these conventional components, the packer 200 has a lower setting cone 224*a*, setting slips 222, and a secondary cone 224*b*. (For reference, FIG. 9A illustrates a detail of the setting slips 222, cones 224*a-b*, and related components on the disclosed packer 200.) The setting slips 222 may be held adjacent the mandrel 202 using shear screws 221. The setting slips 222 are dual direction slips.

The setting tool 100 extends through the mandrel 202 and has an upper coupling 102 for attaching to a running string (not shown). The upper end of the setting tool 100 has the bushing component 120 and the retention sleeve 110. The pipe section 106 comprises several pipe components 106*a-c* that extend from the bushing component 120 and through the pack-off component 140.

During run-in as shown in FIG. 8A, the retention sleeve 110 holds the setting cones 224*a-b* apart. The shear screws 221 hold the setting slips 222 retracted from the casing 10, and the packing assembly 210 (e.g., 212*a-b*, 214, 216) on the packer 200 are uncompressed away from the casing 10. The bushing component 120 on the setting tool 100 engages the latch sub 204 so that the setting tool 100 can run the packer 200 through the casing 10. Meanwhile, the pack-off component 140 encloses the setting tool's pipe section 106 inside the packer 200.

Figure 8B:
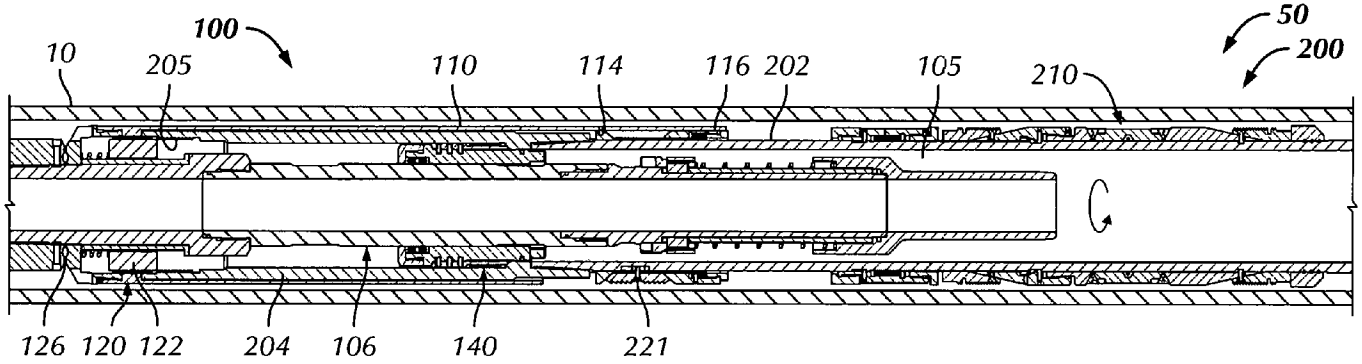

When setting depth is reached, the setting tool 100 is partially released as shown in FIG. 8B. To do this, the setting tool 100 and packer 200 are run to depth, cycling through tension and compression as required. Once the desired depth is reached, the running nut 122 of the bushing component 120 is unthreaded from the latch sub 204 using right-hand rotation of the setting tool 100 via the running string (not shown). This rotation is typically performed in compression to make use of the bearing balls 126. Any suitable number of turns (e.g., approximately 10 right turns) can be required.

Figure 8C:
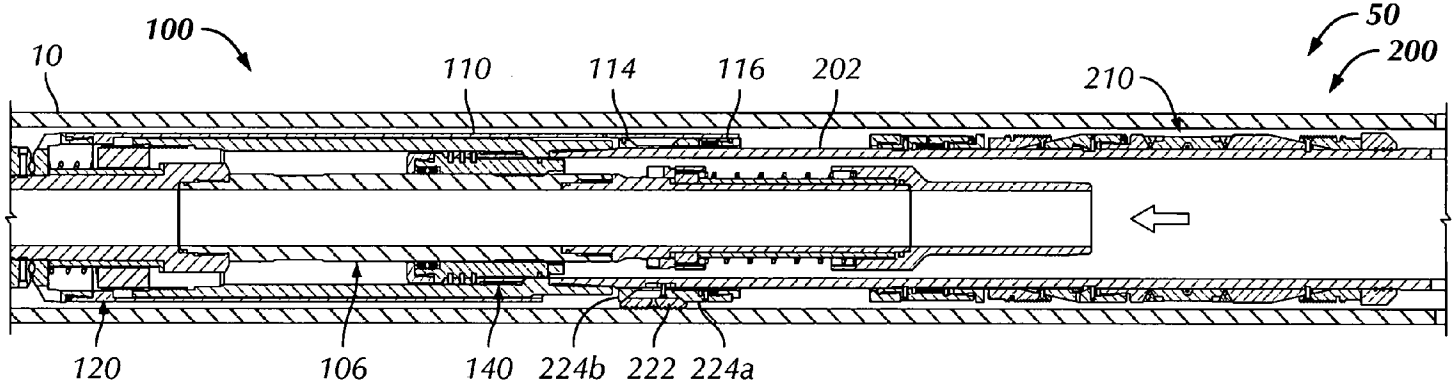

Once the nut 122 is unthreaded from the latch sub 204, the running string is now stroked uphole, as shown in FIG. 8C, to set the setting slips 222. The shear screws 114 affixing the setting sleeve 110 to the secondary cone 224*b* shear free, permitting the lower setting cone 224*a* still affixed to the sleeve 110 to move up with the setting sleeve 110. The movement of setting cone 224*a* against the setting slips 222 shears the shear screws 221 and pushes the setting slips 222 against the casing 10.

Figure 8D:
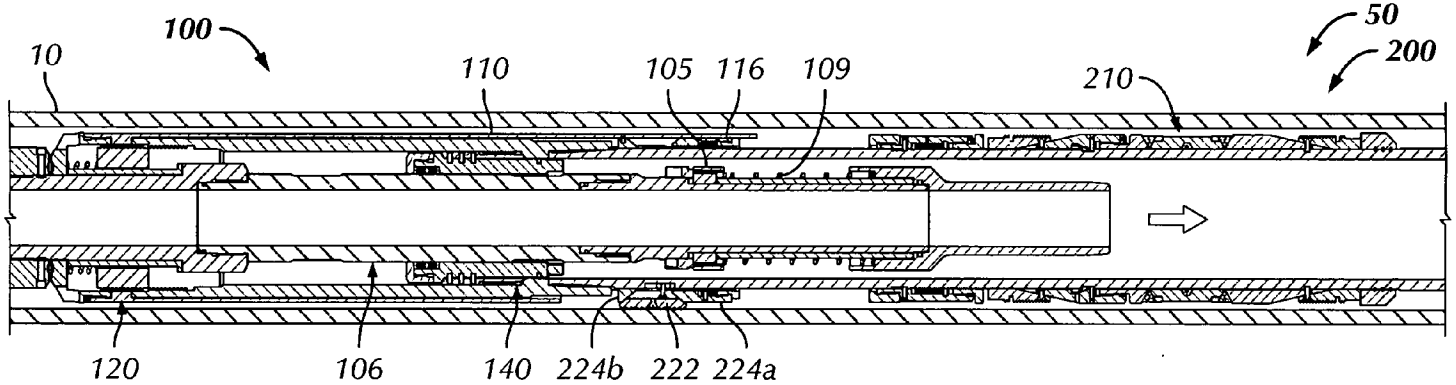

As then shown in FIG. 8D, the setting tool 100 is then stroked down to free the setting sleeve 110 from the lower setting cone 224*a*. For example, a shear connection (generally labelled at 116) can initially retain the setting sleeve 110 to the lower cone 224*a*.

Figures 1, 8D:
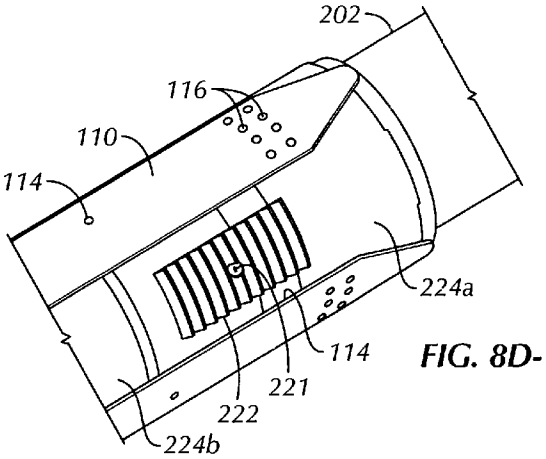

To help illustrate the shear connections 114, 116, 221 of the assembly 50, an isometric view of the setting sleeve 110 and packer mandrel 202 is provided in FIG. 8D-1. As shown, the end of the setting sleeve 110 has slots 112 that accommodate the location of the setting slips 222 between the cones 224*a-b*. The shear screws 221 hold the setting slips 222 against the mandrel 202. On the fingers of the setting sleeve 110 between the slots 112, first shear screws 114 affix the setting sleeve 110 to the upper cone 224*b*. A number of second shear screws 116 also affix the setting sleeve 110 to the lower cone 224*a*.

The upper shear screws 114 retain the sleeve 110 to the upper cone 224*b* and shear when the sleeve 110 is moved uphole to move the lower cone 224*a* against the slips 222. Thus, the slips' shear screws 221 shear at about the same time as the upper shear screws 114. The lower shear screws 116, however, retain the setting sleeve 110 to the lower cone 224*a*. These are sheared after the packer is anchored and the setting sleeve 110 is moved downward on the mandrel 202 to disconnect the sleeve 110 from the lower cone 224*a*. Although upward force may also be applied to shear these screws 221, downward force is preferred to prevent large sudden string movements after shear.

Figure 8E:
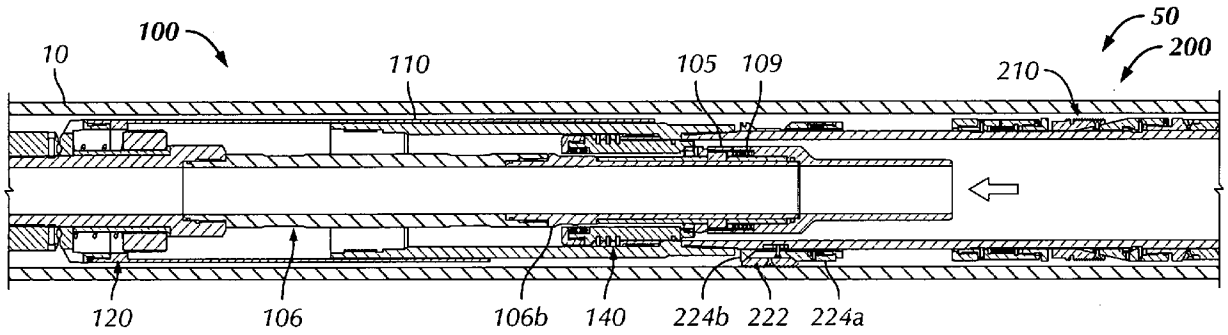
Figure 9B:
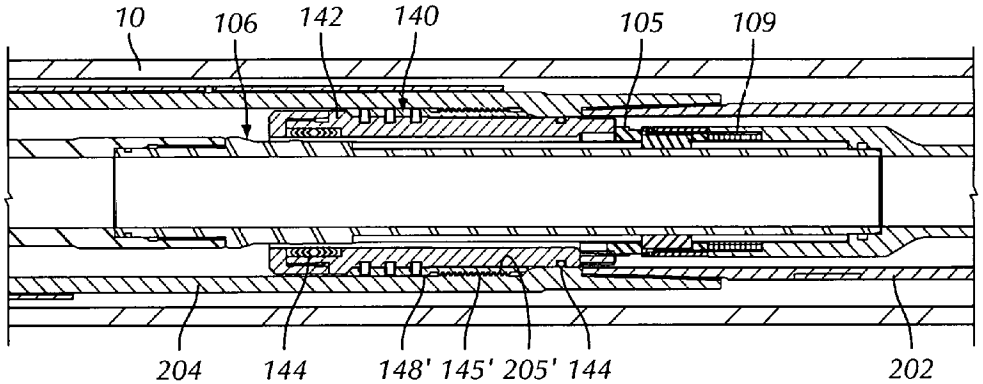
FIG. 9B illustrates a detail of the biased bushing, the pack-off component, and related elements on the disclosed setting tool.

Returning now to the setting procedures, cementing operations can be performed at some point during operations. When cementing is completed, operators may begin setting the liner top packer 200. For example, as shown in FIG. 8E, the setting tool 100 is stroked upward until a biased bushing 105 contacts the pack-off component 140. The setting tool 100 incorporates a biasing element or spring 109 to facilitate setting procedures. In this upward stroke, the spring 109 is compressed solid. Castellations on the biased bushing 105 may mate with the pack-off component 140 in any alignment, and the biased bushing 105 can ride along the splines of the intermediate pipe element 106*b*. (For reference, FIG. 9B illustrates a detail of the biased bushing 105, the pack-off component 140, and related elements on the disclosed setting tool 100.)

Figure 8F:
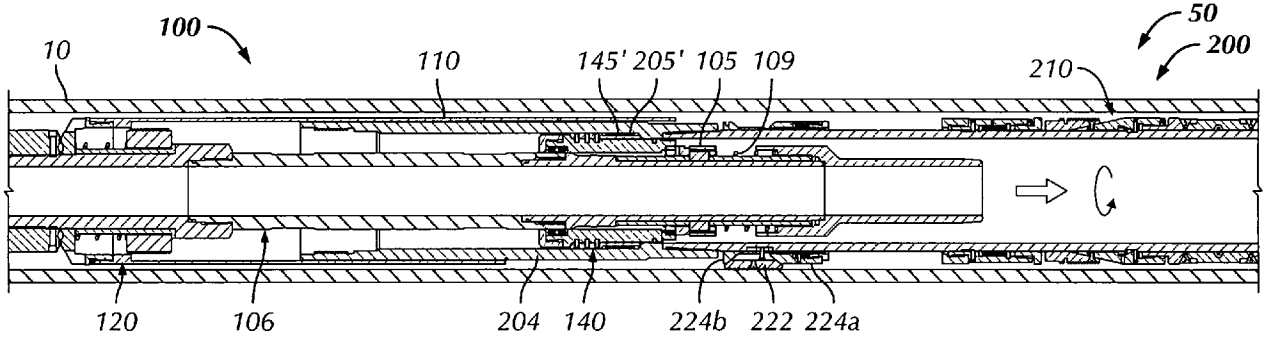

As then shown in FIG. 8F, the setting tool 100 may be stroked down a short distance (e.g., 3-in.), but the biased bushing 105 is held mated with the pack-off component 140 by the spring 109. Operators rotate the setting tool 100 about ½ turn to ensure that the mating castellations are properly aligned.

Figure 8G:
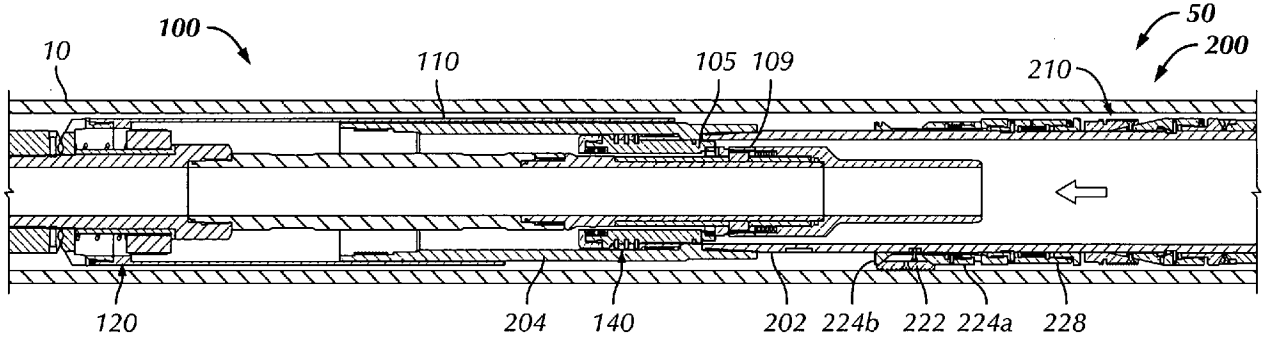

As shown in FIG. 8G, the setting tool 100 is stroked up again with the biased bushing 105 contacting the pack-off component 140 and the spring 109 compressed solid. Pulling up on the setting tool 100 engaged with the pack-off component 140 still coupled to the latch sub 204 thereby lifts the mandrel 202 relative to the engaged setting slip 222. With the uphole movement of the mandrel 202, the setting slips 222 remain anchored in the casing 10, and the ratchet assembly 228 disposed immediately uphole of the packer's packing assembly 210 (e.g., slips 212*a-b*, cones 214, packing element 216, etc.) eventually contacts the lower setting cone 224*a*.

Figure 8H:
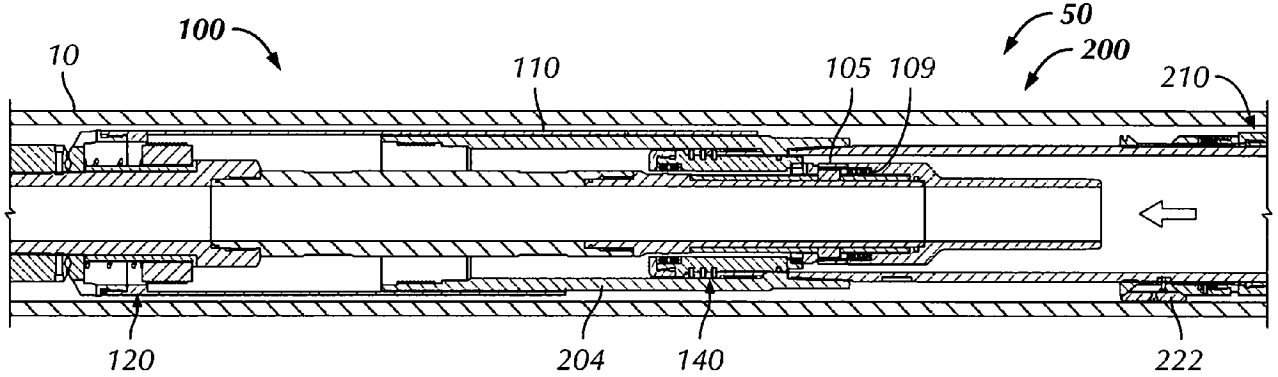
Figure 9C:
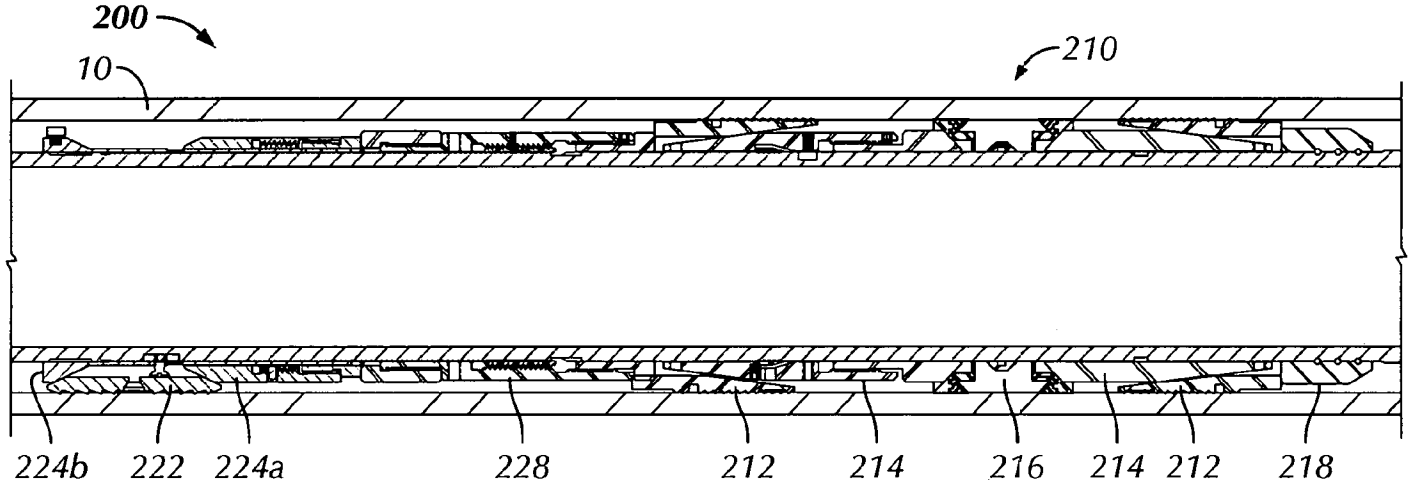
FIG. 9C illustrates a detail of the setting slips compressing the packing component of the packer.

Then, as shown in FIG. 8H, continued stroking up of the setting tool 100 (applying about 50,000-lbf over liner drag) sets the packer 200 by compressing the packing assembly 210. (For reference, FIG. 9C illustrates a detail of the ratchet assembly 228 pushing against the setting slips 222 and compressing the packing assembly 210 of the packer 200 against the end ring 218.)

Figure 8I:
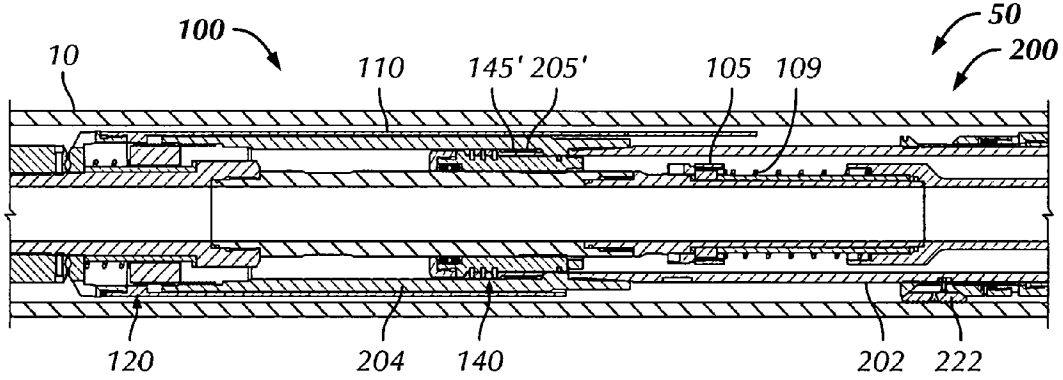
Figure 8J:
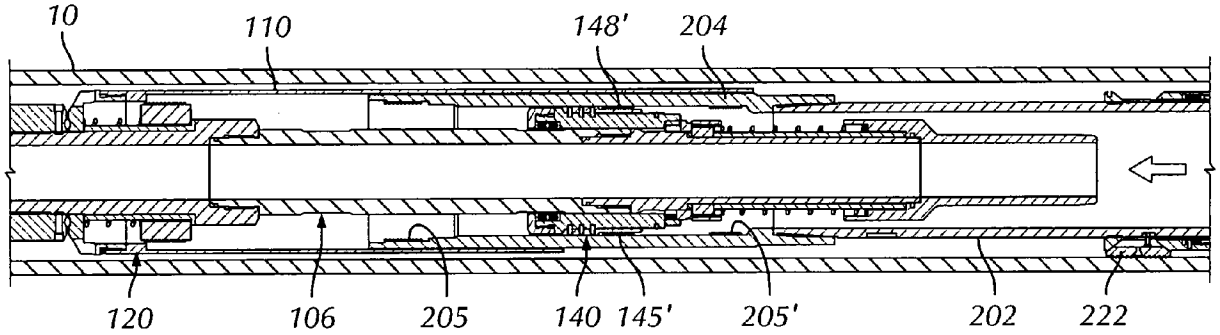
Figure 8K:
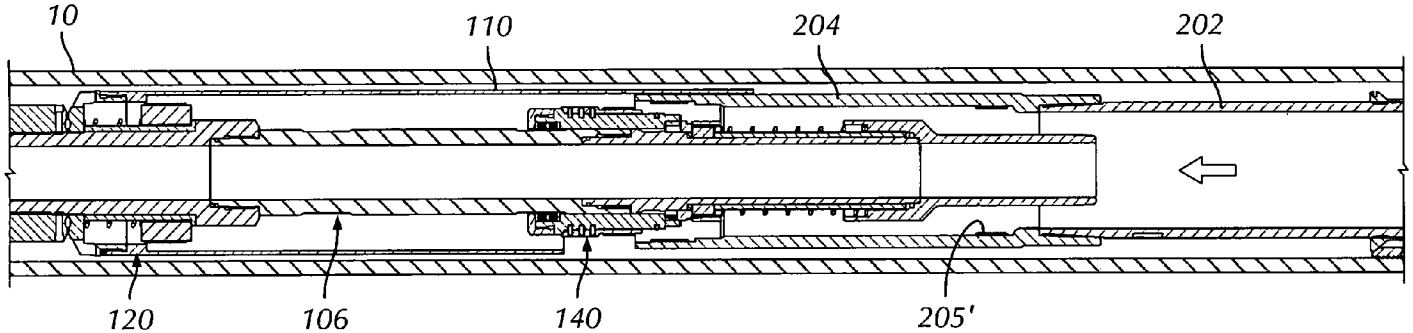

The setting of the packer 200 can be tested as shown in FIG. 8I by stroking the setting tool 100 down to push against the latch sub 204 and the mandrel 202. The setting tool 100 can then be stroked up to the setting limit and then stroked down about an inch with the biased bushing 105 still engaged with the pack-off component 140. To then release the setting tool 100 from the set packer 200, the running string is rotated a number of turns (e.g., 15 right turns) to unthread the pack-off component 140 from inside the latch sub 204 as shown in FIG. 8J. Finally, the setting tool 100 is pulled out of hole as shown in FIG. 8K. Should unthreading fail to release the setting tool 100 from the latch sub 200, the packing component 140 can be sheared free from the component's outer sleeve 148' threaded inside latch sub 204. (See e.g., FIG. 9B.)

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

It is understood that any reference to right-hand rotation above may be replaced with left-hand rotation. However, right-hand rotation is generally preferred as this prevents unthreading of the conventional right-hand threaded tubulars. It is also understood that any mention of direction (e.g., uphole, downhole, up, down, etc.) is merely relative to facilitate explanation. In this regard, although the disclosed packer 200 and setting tool 100 have been disclosed with various components toward uphole and downhole ends and with operations in uphole and downhole directions, it will be appreciated that these orientations and directions can be reversed in a desired implementation.

In general, the disclosed packer 200 can be used in horizontal wells. In this form of use, the liner tubing extending downhole from the packer 200 can rest in a horizontal wellbore so rotation can be established between the running string and the liner tubing during setting procedures. As noted above, for example, rotation is required to release the setting tool 100 from the packer 200 and to release pack-off component 140 from the packer 200. The disclosed packer 200 can also be used in a vertical wellbore, although consideration is required to deal with possible shock loading of components and prematurely shearing various shear screws, preventing proper set and pack-off.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An apparatus for supporting tubing in casing of a borehole, the apparatus comprising:

a packer having a housing, a packing assembly, and a setting slip, the housing defining a bore and coupled to the tubing extending downhole therefrom, the packing assembly disposed on the housing and being compressible from an unpacked state to a packed state in the casing, the setting slip disposed on the housing toward a first end relative the packing assembly and being movable from a retracted state away from the casing to an extended state toward the casing; and a setting tool configured to run the packer in the casing, set the packer in the casing, and remove from the set packer, the setting tool having a first temporary connection to the housing, a first portion of the setting tool temporarily maintaining the setting slip in the retracted state, the first portion mechanically moved in a first direction relative to the housing after disconnection of the first temporary connection and permitting the setting slip to move to the extended state in the casing, a second portion of the setting tool mechanically moving the housing in the first direction after extension of the setting slip, the second portion moving the packing assembly against the engaged setting slip and compressing the packing assembly to the packed state in the casing, the second portion of the setting tool comprising a second temporary connection to the housing.

2. The apparatus of claim 1, wherein the packer comprises a setting cone disposed on the housing adjacent the setting slip, the setting cone being movable in the first direction with the first portion of the setting tool and wedging the setting slip in the extended state against the casing.

3. The apparatus of claim 1, wherein the packing assembly comprises at least one packing slip, at least one packing cone, and at least one compressible packing element disposed on the housing adjacent one another and being movable against one another to pack in the casing.

4. The apparatus of claim 3, wherein the at least one packing cone comprises a ratchet connection to the housing permitting movement of the at least one packing cone in a second direction opposite the first direction along the housing and preventing movement in the first direction.

5. The apparatus of claim 1, wherein the packing assembly comprises:

a compressible packing element disposed on the housing;

first and second cones disposed respectively toward the first end and a second end relative to the compressible packing element; and first and second slips disposed respectively toward the first and second ends relative to the first and second cones, the first slip wedging against the adjacent first cone and keeping the housing from moving in the first direction, the second slip wedging against the adjacent downhole cone and keeping the housing from moving in a second direction opposite to the first direction.

6. The apparatus of claim 1, wherein the setting tool is rotatable relative to the housing to remove the first temporary connection to the housing.

7. The apparatus of claim 6, wherein the first temporary connection comprises a nut disposed on a splined shaft of the setting tool and threaded to a first internal thread in the bore of the housing.

8. The apparatus of claim 1, wherein the first portion of the setting tool comprises a sleeve disposed external to the housing, the sleeve in a first axial position relative to the housing holding the setting slip in the retracted state, the sleeve in a second axial position relative to the housing releasing the hold of the setting slip.

9. The apparatus of claim 8, wherein the setting slip comprises a biasing element biasing the setting slip from the retracted state toward the extended state.

10. The apparatus of claim 1, wherein the first portion of the setting tool comprises a sleeve disposed external to the housing, the sleeve in a first axial position relative to the housing holding a first setting cone away from the setting slip, the sleeve in a second axial position relative to the housing wedging the first setting cone against the setting slip.

11. The apparatus of claim 10, wherein the setting slip comprises a first shearable connection temporarily holding the setting slip in the retracted state, the first shearable connection being shearable in response to the first setting cone wedging against the setting slip.

12. The apparatus of claim 10, wherein the sleeve comprises a second shearable connection temporarily holding the sleeve to a second setting cone disposed adjacent the setting slip opposite to the first setting cone, the second shearable connection being shearable in response to the sleeve moving from the first axial position toward the second axial position.

13. The apparatus of claim 10, wherein the sleeve comprises a third shearable connection temporarily holding the sleeve to the first setting cone, the third shearable connection being shearable in response to the sleeve moving relative to the first setting cone.

14. The apparatus of claim 1, wherein the second temporary connection comprises a pack-off sealing the setting tool inside the bore of the housing.

15. The apparatus of claim 14, wherein the pack-off comprises one or more seals sealing against an exterior portion of the setting tool and against the bore of the housing.

16. The apparatus claim 1, wherein the housing comprises a mandrel and an extension member, the mandrel having the setting slip and the packing assembly disposed thereon, the mandrel coupled toward a second end to the tubing and coupled toward the first end to the extension member, the first and second temporary connections engaged with the extension member, the first portion extending to the mandrel.

17. The apparatus of claim 16, wherein the second portion of the setting tool is movable in the first direction against the second temporary connection, the second portion moved against the second temporary connection moving the housing in the first direction.

18. The apparatus of claim 17, wherein the second portion comprises a shoulder disposed thereon and configured to engage the second temporary connection.

19. The apparatus of claim 18, wherein the shoulder is biased on the second portion by a biasing element against the engagement with the second temporary connection.

20. The apparatus of claim 18, wherein the shoulder defines one or more first castellations configured to mate with one or more second castellations of the second temporary connection.

21. The apparatus of claim 17, wherein the second temporary connection comprises a nut rotatably disposed on the setting tool and threaded to second internal thread in the bore of the housing, the nut unthreading from the second internal thread with rotation of the second portion of the setting tool engaged with the nut.

22. The apparatus of claim 17, wherein the second temporary connection comprises a dog disposed on the setting tool and engaged in the bore of the housing, the dog disengaging from the bore with the movement of the second portion in the first direction.

23. The apparatus of claim 17, wherein the second temporary connection shearably releases from the housing with force applied through the second portion at least after movement of the housing in the first direction has occurred.

24. A method of supporting tubing in casing of a borehole, the method comprising:

running in the tubing in the casing with a setting tool coupled to a packer on the tubing;

disconnecting a first portion of the setting tool from the packer;

setting a setting slip on the packer in the casing by moving the first portion of the setting tool in a first direction relative to the packer;

moving the packer in the first direction by engaging a second portion of the setting tool with the packer;

setting a packing assembly on the packer in the casing by compressing the packing assembly against the set setting slip; and removing the setting tool from the packer for retrieval out of the casing by disconnecting the second portion of the setting tool from the packer.

25. The method of claim 24, wherein disconnecting the first portion of the setting tool from the packer comprises rotating the setting tool relative to the packer, and unthreading a nut on the setting tool from first internal thread of the packer.

26. The method of claim 24, wherein setting the setting slip on the packer in the casing by moving the first portion of the setting tool in the first direction relative to the packer comprises moving a sleeve of the setting tool away from the setting slip and biasing the setting slip against the casing.

27. The method of claim 24, wherein setting the setting slip on the packer in the casing by moving the first portion of the setting tool in the first direction relative to the packer comprises moving a sleeve of the setting tool relative to the packer and wedging the setting slip against the casing with the movement of the sleeve.

28. The method of claim 24, wherein moving the packer in the first direction by engaging the first portion of the setting tool with the packer comprises engaging a first shoulder disposed on the setting tool against a second shoulder disposed in the packer.

29. The method of claim 24, wherein setting the packing assembly on the packer in the casing by compressing the packing assembly against the set setting slip comprises moving at least one slip, at least one cone, and a packing element disposed on a housing of the packer against one another with the set setting slip engaged in the casing.

30. The method of claim 24, wherein disconnecting the second portion of the setting tool from the packer comprises rotating the setting tool relative to the packer, and unthreading a nut of the setting tool from second internal thread of the packer.

31. The method of claim 30, wherein unthreading the nut from second internal thread of the packer comprises engaging one or more castellations on the setting tool with the nut.

32. The method of claim 24, wherein disconnecting the second portion of the setting tool from the packer comprises disengaging a dog of the setting tool from a profile in the packer.

33. The method of claim 24, further comprising cementing the tubing in the borehole by conducting the cement through the setting tool.

34. An apparatus for supporting tubing in casing of a borehole, the apparatus comprising:

a packer having a housing, a packing assembly, and a setting slip, the housing defining a bore and coupled to the tubing extending downhole therefrom, the packing assembly disposed on the housing and being compressible from an unpacked state to a packed state in the casing, the setting slip disposed on the housing toward a first end relative the packing assembly and being movable from a retracted state away from the casing to an extended state toward the casing; and a setting tool configured to run the packer in the casing, set the packer in the casing, and remove from the set packer, the setting tool having a first temporary connection to the housing, a first portion of the setting tool temporarily maintaining the setting slip in the retracted state, the first portion mechanically moved in a first direction relative to the housing after disconnection of the first temporary connection and permitting the setting slip to move to the extended state in the casing, a second portion of the setting tool mechanically moving the housing in the first direction after extension of the setting slip, the second portion moving the packing assembly against the engaged setting slip and compressing the packing assembly to the packed state in the casing, wherein the setting tool is rotatable relative to the housing to remove the first temporary connection to the housing, and wherein the first temporary connection comprises a nut disposed on a splined shaft of the setting tool and threaded to a first internal thread in the bore of the housing.

35. The apparatus of claim 34, wherein the first portion of the setting tool comprises a sleeve disposed external to the housing, the sleeve in a first axial position relative to the housing holding the setting slip in the retracted state, the sleeve in a second axial position relative to the housing releasing the hold of the setting slip.

36. The apparatus of claim 35, wherein the setting slip comprises a biasing element biasing the setting slip from the retracted state toward the extended state.

37. The apparatus of claim 34, wherein the first portion of the setting tool comprises a sleeve disposed external to the housing, the sleeve in a first axial position relative to the housing holding a first setting cone away from the setting slip, the sleeve in a second axial position relative to the housing wedging the first setting cone against the setting slip.

38. The apparatus of claim 37, wherein the setting slip comprises a first shearable connection temporarily holding the setting slip in the retracted state, the first shearable connection being shearable in response to the first setting cone wedging against the setting slip.

39. The apparatus of claim 37, wherein the sleeve comprises a second shearable connection temporarily holding the sleeve to a second setting cone disposed adjacent the setting slip opposite to the first setting cone, the second shearable connection being shearable in response to the sleeve moving from the first axial position toward the second axial position.

40. The apparatus of claim 37, wherein the sleeve comprises a third shearable connection temporarily holding the sleeve to the first setting cone, the third shearable connection being shearable in response to the sleeve moving relative to the first setting cone.

* * * * *